US006209924B1

(12) United States Patent
Pyle et al.

(10) Patent No.: US 6,209,924 B1
(45) Date of Patent: Apr. 3, 2001

(54) AESTHETICALLY PLEASING GREETING CARD

(76) Inventors: Theresa Pyle; Larry Pyle, both of 7888 Silverton Ave., Suite G, San Diego, CA (US) 92126

( * ) Notice: Subject to any disclaimer, the term of this patent is extended or adjusted under 35 U.S.C. 154(b) by 0 days.

(21) Appl. No.: 09/262,937

(22) Filed: Mar. 5, 1999

(51) Int. Cl.[7] ..... B42D 15/00

(52) U.S. Cl. ..... 283/117; 283/117; 40/124.1; 40/365; 40/427; 40/700

(58) Field of Search ..... 283/117, 61, 62; 40/124.1, 365, 700, 427

(56) References Cited

U.S. PATENT DOCUMENTS 1,500,025 * 7/1924 Mayer ..... 40/59
2,014,743 * 9/1935 Metzler et al. ..... 40/59
5,551,730 * 9/1996 Barreca et al. ..... 283/117
5,873,603 * 2/1999 Carless et al. ..... 283/61
5,941,573 * 8/1999 Yordinsky ..... 283/117

* cited by examiner

*Primary Examiner*—Stephen F. Gerrity
*Assistant Examiner*—Daniel Phan
(74) *Attorney, Agent, or Firm*—Donn K. Harms

(57) ABSTRACT

An aesthetically pleasing greeting card having a light transmitting carrier with a scene printed on both sides of the front cover thereof inserted and adhered between two substantially equal sized folded over sections with substantially equal sized cutouts therethrough. The scenes are identical with one being the reverse of the other so that when viewing through the cutouts and the light transmitting carrier from either side thereof toward a light source one bright common scene is viewed with one side having a reverse scene from the other side. The greeting card has a solid back either with printed indica thereon or left blank for the user to inscribe thereon.

7 Claims, 1 Drawing Sheet

AESTHETICALLY PLEASING GREETING CARD

FIELD OF THE INVENTION

This invention is directed generally to greeting cards and more particularly to a greeting card with a pleasing image that is printed on each side of light transmitting material so as to provide a sharp bright image when viewed through the light transmitting material from either side of the image, i.e. the front or back.

BACKGROUND OF THE INVENTION

Illustrated greeting cards either plain for the user to write a greeting thereon or pre-printed with a commercial greeting therein. The greeting cards are made for all an any occasions. The result is the production of thousands of different greeting cards and the like.

There are greeting cards that have openings through the front surface or cover that allows the viewer to view a image through the opening that is present on the back surface of the greeting card. Examples of this type greeting card can be found in U.S. Pat. No. 5,303,957, 5,435,603 and 5,551,730 by Inventor Robert Barreca et al. The viewing of the image of these cards is intended to be from the front of the card. When solid backing for the image is provided the image can not be viewed from the back of the card, i.e. the image can only be viewed from the front opening. When the solid backing is not provided the back of the image provides a dull and unpleasant image to the viewer as the intent is to view the image from the front of the card only and, therefore, the image is not duplicated on the back surface of the translucent image carrier.

U.S. Pat. No. 5,303,487 also teaches an image can be viewed through a opening in the front surface of the greeting card. This invention has a solid backing for the image and, therefore, the image cannot be viewed from the back surface of the card.

The purpose of the instant invention is to fill a void in the greeting card art by providing a decorative greeting card with a pleasing image on the front surface that has the same image that is equally aesthetically pleasing when viewed from opposite side, i.e. front or back, of the image.

SUMMARY OF THE INVENTION

The instant invention is directed to a unique greeting card that has a front opening with a pleasing image positioned therein. The image in the opening is printed on both first and second sides of a suitable light transmitting sheet material such as, vellum, acetate and any other material for the purpose intended. The image is printed on the first surface of the light transmitting sheet material and printed backward to the image on the first surface on the back or opposite second surface of the light transmitting sheet material the two images register so that when viewing the image from either side of the light transmitting sheet material the common image is bright and clear to the viewer. This is in contrast to only printing on one surface of the light transmitting material wherein the image is dull and unclear for viewing on the non printed side.

An object of this invention is to provide a greeting card with a clear bright translucent surface image that when viewed from either side of the image depicts equal brightness and clarity.

The above and other objects, features, and advantages of the present invention will become apparent in the following detailed description of the preferred embodiment thereof when taken with the accompanying drawings in which like reference numerals denote like or similar parts throughout the several drawings.

BRIEF DESCRIPTION OF THE DRAWING FIGURES

DETAILED DESCRIPTION OF THE PREFERRED EMBODIMENT

Figure 1:
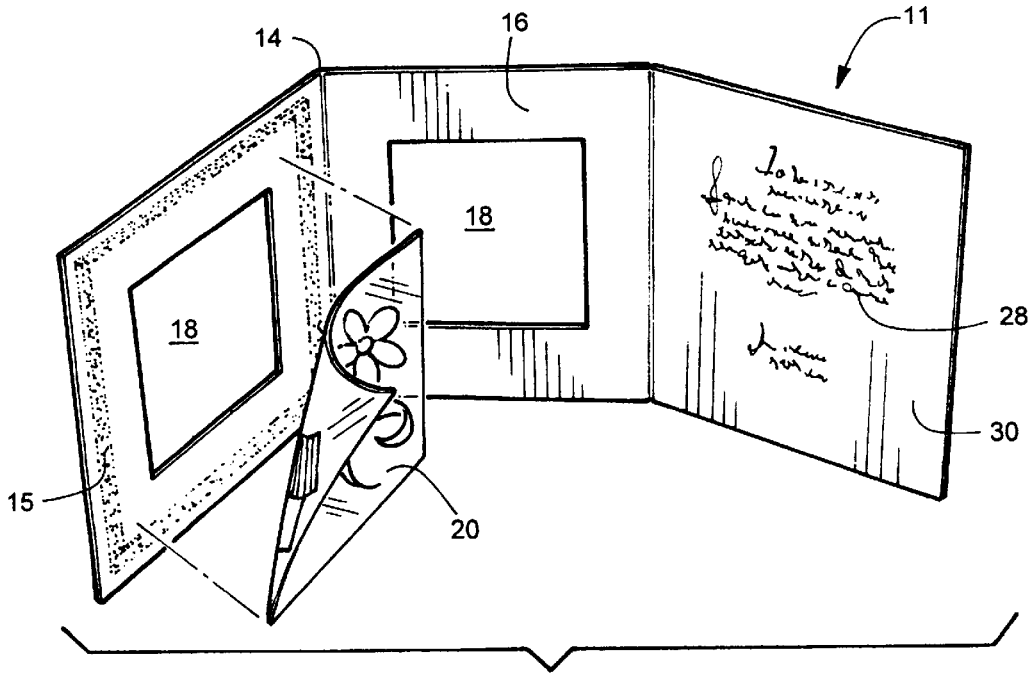
FIG. 1 depicts the material used to construct a typical greeting card of the invention.
Figure 2:
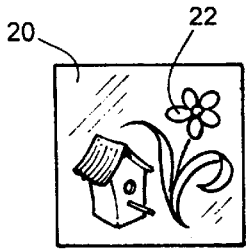
FIG. 2 depicts the front view of the printed light transmitting material received in an opening in the greeting card.
Figure 3:
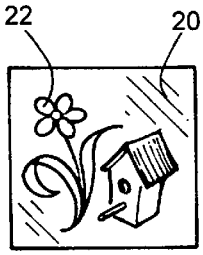
FIG. 3 is a showing of the reverse side of the printed material if FIG. 2.

Referring now to the various drawings Figures. Referring now specifically to drawing FIGS. 1–3, FIG. 1 depicts a showing of a pre-sized piece of rectangular material 10 typically used to make greeting card 11. It should be understood that any shaped material can be utilized providing that it can be folded into three sections at least two of which are substantially the same physical shape. The third section can be of substantially the same physical shape as the other two sections or take any other different shape.

In forming the finished greeting card, section 12 is folded along line 14 so as to over lay section 16 with openings 18 in alignment. It should be understood that the opening 18 can take any configuration in addition to that shown.

Figure 5:
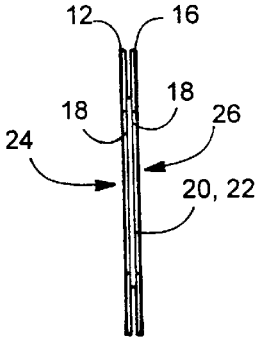
FIG. 5 is an slightly enlarged showing taken along line 5—5 of FIG. 4.

Prior to the folding over of section 12, a light transmitting 20 material with an aesthetically pleasing scene 22 thereon and slightly larger in dimension is inserted between sections 12 and 16 and is adhered by any adhesive 15 suitable for this purpose to one section or the other so that the scene on the light transmitting material is exposed through the opening 18 and affixed therein, see drawing FIG. 5 for the position of the various elements and their relative physical positions one to the other.

Figure 4:
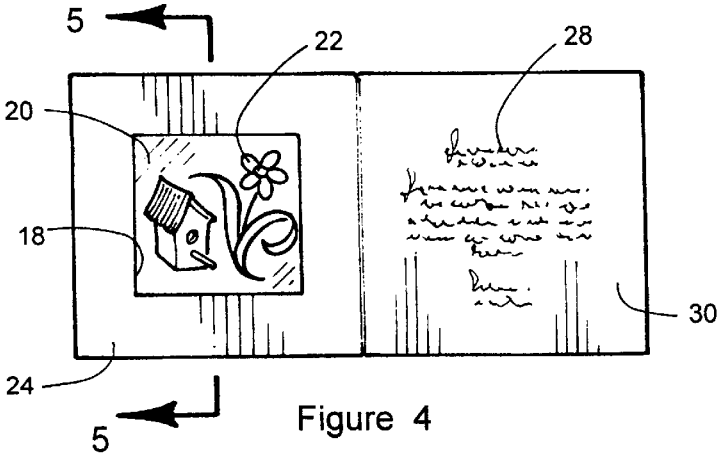
FIG. 4 is a showing of the greeting card material with the printed light transmitting material positioned between the folded over portion of the material forming the greeting card.

After insertion and the adhering of the light transmitting material to the section 12 or 16, Section 12 is adhered to section 16 to form a single section 24 of the greeting card 11, see drawing FIG. 4.

The scene depicted in drawing FIG. 2 is printed or otherwise affixed onto the light transmitting material 20 by any convenient means known in the printing or photo transfer art. The scene 22 is the same scene 22 shown in Drawing FIG. 2 except it is printed in the reverse of the scene on in drawing FIG. 2. The printed scenes on both sides of the light transmitting material 20 register so that when viewing from either side toward a light source along arrows 24 or 26 of the light transmitting material they appear to be but one scene with each side depicting the same scene with one scene being the reverse of the other.

Figure 6:
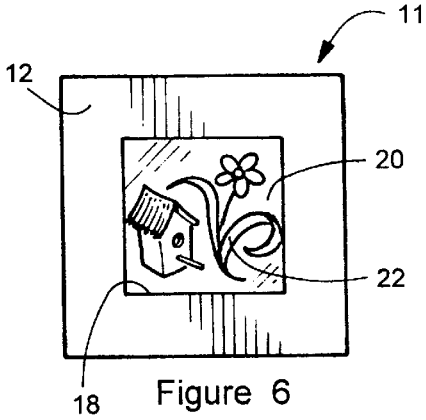
FIG. 6 is a showing of the front of the greeting card of FIG. 1.

Drawing FIG. 6 depicts the front of the aesthetically pleasing card of the invention.

Drawing FIGS. 1 and 4 show inscriptions 28 on the inside of the section 30 that forms the back of the greeting card these inscriptions can be commercially produced or inscribed by the owner of the card.

It should be understood that any photograph, drawing or any thing that can be scanned to a convenient printing process can be used as the fore mentioned scene 22.

The material forming the card 11 can be any die cut card stock or any other material suitable for the purpose intended.

It should be under stood that while the intention has been described in detail herein, the invention can be embodied otherwise without departing from the principles thereof, and such other embodiments are meant to come within the scope of the present invention as described by the appended claims.

What is claimed is:

1. An aesthetically pleasing greeting card comprising:

a frame, said frame being folded in three sections with at least two of the sections being of substantially equal sized areas, an outer one of said at least two substantially equal sized areas being folded toward and fixedly secured to the adjacent center one of said at least two substantially equal sized areas forming a double thickness, said frame forming said double thickness having an opening there through with the remaining one of said three folded areas being folded toward the two fixedly secured areas for forming a solid back surface for said greeting card and a piece of light transmitting material having a first outer and a second inner side with a pleasing image positioned on said first outer side and the reverse of that image positioned on said second inner side, the images registering one over the other to form a single image when viewed from either the first outer or second inner side, said piece of light transmitting material being inserted between said two folded over areas prior to fixedly securing the two areas together and located substantially coextensive with said opening, said pleasing image can be viewed from either said first outer or second inner side of said two folded over areas through said light transmitting material whereby a greeting card is formed having a front outer side and a second inner side with said pleasing image viewable from either side thereof.

2. The invention as defined in claim 1 wherein said frame is rectangular.

3. The invention as defined in claim 1 wherein said light transmitting material is transparent.

4. The invention as defined in claim 1 wherein said light transmitting material is translucent.

5. The invention as defined in claim 1 wherein the opening through the double thickness is rectangular.

6. The invention as defined in claim 1 wherein said three sections are of substantially equal size areas.

7. The invention as defined in claim 1 wherein one of said sections is of a different sized area from said at least two sections of equal sized areas.

* * * * *